US008882520B2

(12) United States Patent
Youtsey

(10) Patent No.: US 8,882,520 B2
(45) Date of Patent: Nov. 11, 2014

(54) CONNECTOR WITH A LOCKING MECHANISM AND A MOVABLE COLLET

(75) Inventor: Timothy L. Youtsey, Scottsdale, AZ (US)

(73) Assignee: PCT International, Inc., Mesa, AZ (US)

( * ) Notice: Subject to any disclaimer, the term of this patent is extended or adjusted under 35 U.S.C. 154(b) by 0 days.

(21) Appl. No.: 13/113,027

(22) Filed: May 20, 2011

(65) Prior Publication Data

US 2011/0287653 A1 Nov. 24, 2011

Related U.S. Application Data

(60) Provisional application No. 61/347,364, filed on May 21, 2010, provisional application No. 61/432,871, filed on Jan. 14, 2011.

(51) Int. Cl.

| | |
|---|---|
| ***H01R 13/62*** | (2006.01) |
| ***H01R 13/193*** | (2006.01) |
| ***H01R 4/50*** | (2006.01) |
| ***H01R 13/629*** | (2006.01) |
| ***H01R 4/26*** | (2006.01) |

(52) U.S. Cl.

CPC ..... *H01R 13/193* (2013.01); *H01R 4/5008* (2013.01); *H01R 13/62933* (2013.01); *H01R 4/26* (2013.01)

USPC ..... 439/157

(58) Field of Classification Search

USPC ..... 439/345, 157–160, 352, 358, 578

See application file for complete search history.

(56) References Cited

U.S. PATENT DOCUMENTS

| | | | |
|---|---|---|---|
| 2,178,365 | A | 10/1939 | Brobst |
| 2,232,846 | A | 2/1941 | Freydberg |
| 2,233,216 | A | 2/1941 | Matthysse |
| 2,304,711 | A | 12/1942 | Shenton |
| D140,861 | S | 4/1945 | Conlan |
| 2,669,695 | A | 9/1952 | Bird |

(Continued)

FOREIGN PATENT DOCUMENTS

| | | |
|---|---|---|
| DE | 3111832 | 10/1982 |
| DE | 10050445 | 4/2002 |

(Continued)

OTHER PUBLICATIONS

International Search Report and Written Opinion; PCT Application No. PCT/US2011/037477; Applicant: Youtsey, Timothy; Date of Mailing: Jul. 11, 2011, 11 pages.

(Continued)

*Primary Examiner* — Chandrika Prasad

(74) *Attorney, Agent, or Firm* — Perkins Coie LLP

(57) ABSTRACT

Connectors with locking mechanisms and associated systems and methods are disclosed herein. A connector in accordance with an embodiment of the present technology, for example, can include a connector body having an inner surface defining a first bore and a collet movably received in the first bore. The collet can have an inner surface defining a second bore that is configured to receive a mating second connector. The connector can further include a locking mechanism that is operably coupled to the connector body and has an open position and a closed position. The collet is configured to operably engage the second connector when the locking mechanism is in the closed position and release the second connector when the locking mechanism in the open position.

30 Claims, 14 Drawing Sheets

(56) References Cited

U.S. PATENT DOCUMENTS 3,076,235 A 2/1963 Rollins et al.
3,274,447 A 9/1966 Nelson
3,275,737 A 9/1966 Caller
3,344,227 A 9/1967 Gilmartin et al.
3,366,920 A 1/1968 Laudig et al.
3,229,623 A 4/1968 Kempf
3,390,374 A 6/1968 Forney, Jr.
3,489,988 A 1/1970 Carnaghan
3,517,375 A 6/1970 Mancini
3,544,705 A 12/1970 Winston
3,601,776 A 8/1971 Curl
3,609,651 A 9/1971 Sladek et al.
3,653,689 A 4/1972 Sapy et al.
3,662,090 A 5/1972 Grey
3,671,922 A 6/1972 Zerlin et al.
3,708,781 A 1/1973 Trompeter
3,740,453 A 6/1973 Callaghan et al.
3,746,931 A * 7/1973 Muranaka ..... 174/503
3,777,298 A * 12/1973 Newman ..... 439/191
3,778,535 A 12/1973 Forney, Jr.
3,836,700 A 9/1974 Niemeyer
3,863,111 A 1/1975 Martzloff
4,029,006 A 6/1977 Mercer
4,096,346 A 6/1978 Stine et al.
4,100,003 A 7/1978 Trusch
4,117,260 A 9/1978 Wilkenloh
4,125,739 A 11/1978 Bow
4,159,859 A 7/1979 Shemtov
4,221,926 A 9/1980 Schneider
4,225,162 A 9/1980 Dola
4,307,926 A 12/1981 Smith
4,371,742 A 2/1983 Manly
4,400,050 A 8/1983 Hayward
4,408,822 A 10/1983 Nikitas
4,439,632 A 3/1984 Aloisio et al.
4,465,717 A 8/1984 Crofts et al.
4,472,595 A 9/1984 Fox et al.
4,484,023 A 11/1984 Gindrup
4,509,090 A 4/1985 Kawanami et al.
4,515,992 A 5/1985 Gupta
RE31,995 E 10/1985 Ball
4,557,560 A 12/1985 Bohannon, Jr. et al.
4,564,723 A 1/1986 Lang
4,569,704 A 2/1986 Bohannon, Jr. et al.
4,572,692 A 2/1986 Sauber
4,595,431 A 6/1986 Bohannon, Jr. et al.
4,604,773 A 8/1986 Weber et al.
4,619,497 A 10/1986 Vogel et al.
4,633,359 A 12/1986 Mickelson et al.
4,641,110 A 2/1987 Smith
4,684,201 A 8/1987 Hutter
4,691,081 A 9/1987 Gupta
4,718,854 A 1/1988 Capp et al.
4,729,629 A 3/1988 Saito et al.
4,755,152 A 7/1988 Elliot et al.
4,760,362 A 7/1988 Maki
4,774,148 A 9/1988 Goto
4,875,864 A 10/1989 Campbell
4,894,488 A 1/1990 Gupta
4,915,651 A 4/1990 Bout
4,965,412 A 10/1990 Lai
4,990,106 A 2/1991 Szegda
4,997,994 A 3/1991 Andrews et al.
5,011,432 A 4/1991 Sucht et al.
5,041,020 A 8/1991 Michael
5,043,538 A 8/1991 Hughey, Jr. et al.
5,043,539 A 8/1991 Connole et al.
5,049,721 A 9/1991 Parnas et al.
5,073,129 A 12/1991 Szegda
5,083,943 A 1/1992 Tarrant
5,096,444 A 3/1992 Lu et al.
5,123,863 A 6/1992 Frederick et al.
5,132,491 A 7/1992 Mulrooney et al.
5,141,448 A 8/1992 Mattingly et al.
5,145,382 A 9/1992 Dickirson
5,147,221 A 9/1992 Cull et al.
5,161,993 A 11/1992 Leibfried, Jr.
5,195,905 A 3/1993 Pesci
5,195,910 A 3/1993 Enomoto et al.
5,198,958 A 3/1993 Krantz, Jr.
5,205,547 A 4/1993 Mattingly
5,216,202 A 6/1993 Yoshida et al.
5,217,393 A 6/1993 Del Negro et al.
5,237,293 A 8/1993 Kan et al.
5,276,415 A 1/1994 Lewandowski et al.
5,281,167 A 1/1994 Le et al.
5,284,449 A 2/1994 Vaccaro
5,295,864 A 3/1994 Birch et al.
5,306,170 A 4/1994 Luu
5,316,348 A 5/1994 Franklin
5,318,458 A 6/1994 Thorner
5,329,064 A 7/1994 Tash
5,355,720 A 10/1994 Bailey
5,367,925 A 11/1994 Gasparre
5,383,708 A 1/1995 Nagasaka et al.
5,412,856 A 5/1995 Nazerian et al.
5,414,213 A 5/1995 Hillburn
5,439,399 A 8/1995 Spechts et al.
5,470,257 A 11/1995 Szegda
5,471,144 A 11/1995 Meyer et al.
5,498,175 A 3/1996 Yeh et al.
5,507,537 A 4/1996 Meisinger et al.
5,525,076 A 6/1996 Down
5,548,088 A 8/1996 Gray et al.
5,560,536 A 10/1996 Moe
5,564,938 A 10/1996 Shenkal et al.
5,595,499 A 1/1997 Zander et al.
5,607,325 A 3/1997 Toma
5,632,633 A 5/1997 Roosdorp et al.
5,632,651 A 5/1997 Szegda
5,651,698 A 7/1997 Locati et al.
5,660,565 A 8/1997 Williams
5,667,409 A 9/1997 Wong et al.
5,700,160 A 12/1997 Lee
5,707,465 A 1/1998 Bibber
5,719,353 A 2/1998 Carlson et al.
5,724,220 A 3/1998 Chaudhry
5,730,622 A 3/1998 Olson
5,796,042 A 8/1998 Pope
5,829,992 A 11/1998 Merker et al.
5,830,010 A 11/1998 Miskin et al.
5,857,711 A 1/1999 Comin-DuMong et al.
5,860,833 A 1/1999 Chillscyzn et al.
5,863,226 A 1/1999 Lan et al.
5,865,654 A 2/1999 Shimirak et al.
5,882,233 A 3/1999 Idehara
5,890,762 A 4/1999 Yoshida
5,926,949 A 7/1999 Moe et al.
5,927,975 A 7/1999 Esrock
5,938,465 A 8/1999 Fox, Sr.
5,945,632 A 8/1999 Butera
5,949,018 A 9/1999 Esker
5,953,195 A 9/1999 Pagliuca
5,959,245 A 9/1999 Moe et al.
5,969,295 A 10/1999 Boucino et al.
5,984,378 A 11/1999 Ostrander et al.
5,991,136 A 11/1999 Kaczmarek et al.
6,010,349 A 1/2000 Porter, Jr.
6,011,218 A 1/2000 Burek et al.
6,024,408 A 2/2000 Bello
6,027,373 A 2/2000 Gray et al.
6,037,545 A 3/2000 Fox et al.
6,042,422 A 3/2000 Youtsey
6,048,233 A 4/2000 Cole
6,065,997 A 5/2000 Wang
6,071,144 A 6/2000 Tang
6,087,017 A 7/2000 Bibber
6,109,963 A 8/2000 Follingstad et al.
6,113,431 A 9/2000 Wong
6,127,441 A 10/2000 Sakamoto et al.
6,137,058 A 10/2000 Moe et al.
6,140,582 A 10/2000 Sheehan
6,142,788 A 11/2000 Han
6,146,196 A 11/2000 Burger et al.

(56) References Cited

U.S. PATENT DOCUMENTS

| | | | | |
|---|---|---|---|---|
| 6,148,130 | A | 11/2000 | Lee et al. | |
| 6,174,206 | B1 | 1/2001 | Yentile et al. | |
| 6,183,297 | B1 | 2/2001 | Kay et al. | |
| 6,183,298 | B1 | 2/2001 | Henningsen | |
| 6,201,189 | B1 | 3/2001 | Carlson et al. | |
| 6,201,190 | B1 | 3/2001 | Pope | |
| 6,204,445 | B1 | 3/2001 | Gialenios et al. | |
| 6,210,221 | B1 | 4/2001 | Maury | |
| 6,210,222 | B1 | 4/2001 | Langham et al. | |
| 6,246,006 | B1 | 6/2001 | Hardin et al. | |
| 6,249,415 | B1 | 6/2001 | Daoud et al. | |
| 6,250,960 | B1 | 6/2001 | Youtsey | |
| 6,265,667 | B1 | 7/2001 | Stipes et al. | |
| 6,282,778 | B1 | 9/2001 | Fox et al. | |
| 6,288,628 | B1 | 9/2001 | Fujimori | |
| 6,326,551 | B1 | 12/2001 | Adams | |
| 6,371,585 | B2 | 4/2002 | Kurachi | |
| 6,372,990 | B1 | 4/2002 | Saito et al. | |
| 6,384,337 | B1 | 5/2002 | Drum | |
| 6,396,367 | B1 | 5/2002 | Rosenberger | |
| D459,306 | S | 6/2002 | Malin | |
| 6,417,454 | B1 | 7/2002 | Biebuyck | |
| 6,450,836 | B1 | 9/2002 | Youtsey | |
| 6,462,436 | B1 | 10/2002 | Kay et al. | |
| 6,468,100 | B1 | 10/2002 | Meyer et al. | |
| 6,498,301 | B1 | 12/2002 | Pieper et al. | |
| 6,540,293 | B1 | 4/2003 | Quackenbush | |
| 6,545,222 | B2 | 4/2003 | Yokokawa et al. | |
| 6,591,055 | B1 | 7/2003 | Eslambolchi et al. | |
| 6,596,393 | B1 | 7/2003 | Houston et al. | |
| 6,610,931 | B2 | 8/2003 | Perelman et al. | |
| 6,648,683 | B2 | 11/2003 | Youtsey | |
| 6,712,631 | B1 | 3/2004 | Youtsey | |
| 6,734,364 | B2 | 5/2004 | Price et al. | |
| 6,770,819 | B2 | 8/2004 | Patel | |
| 6,798,310 | B2 | 9/2004 | Wong et al. | |
| 6,800,809 | B2 | 10/2004 | Moe et al. | |
| 6,800,811 | B1 | 10/2004 | Boucino | |
| 6,818,832 | B2 | 11/2004 | Hopkinson et al. | |
| 6,846,536 | B1 | 1/2005 | Priesnitz et al. | |
| 6,848,939 | B2 | 2/2005 | Stirling | |
| 6,858,805 | B2 | 2/2005 | Blew et al. | |
| 6,875,928 | B1 | 4/2005 | Hayes et al. | |
| 6,877,996 | B1 | 4/2005 | Franks, Jr. | |
| 6,915,564 | B2 | 7/2005 | Adams | |
| D508,676 | S | 8/2005 | Franks, Jr. | |
| 6,997,999 | B2 | 2/2006 | Houston et al. | |
| 7,022,918 | B2 | 4/2006 | Gialenios et al. | |
| 7,077,475 | B2 | 7/2006 | Boyle | |
| 7,084,343 | B1 | 8/2006 | Visser | |
| 7,127,806 | B2 | 10/2006 | Nelson et al. | |
| 7,131,868 | B2 * | 11/2006 | Montena | 439/578 |
| 7,144,273 | B1 | 12/2006 | Chawgo | |
| 7,147,509 | B1 | 12/2006 | Burris et al. | |
| 7,157,645 | B2 | 1/2007 | Huffman | |
| 7,159,948 | B1 | 1/2007 | Wolf | |
| 7,183,743 | B2 | 2/2007 | Geiger | |
| 7,198,495 | B1 | 4/2007 | Youtsey | |
| 7,278,684 | B2 | 10/2007 | Boyle | |
| 7,299,550 | B2 | 11/2007 | Montena | |
| 7,306,484 | B1 | 12/2007 | Mahoney et al. | |
| 7,311,555 | B1 | 12/2007 | Burris et al. | |
| 7,314,998 | B2 | 1/2008 | Amato et al. | |
| 7,350,767 | B2 | 4/2008 | Huang | |
| 7,404,737 | B1 | 7/2008 | Youtsey | |
| 7,468,489 | B2 | 12/2008 | Alrutz | |
| 7,497,002 | B2 | 3/2009 | Chawgo | |
| 7,500,874 | B2 | 3/2009 | Montena | |
| 7,507,117 | B2 | 3/2009 | Amidon | |
| 7,513,795 | B1 | 4/2009 | Shaw | |
| 7,566,236 | B2 | 7/2009 | Malloy et al. | |
| 7,837,501 | B2 | 11/2010 | Youtsey | |
| 7,841,912 | B2 * | 11/2010 | Hachadorian | 439/736 |
| 7,887,354 | B2 | 2/2011 | Holliday | |
| 8,075,338 | B1 | 12/2011 | Montena | |
| 8,079,860 | B1 | 12/2011 | Zraik | |
| 8,113,875 | B2 | 2/2012 | Malloy et al. | |
| 8,113,879 | B1 | 2/2012 | Zraik | |
| 8,152,551 | B2 | 4/2012 | Zraik | |
| 8,157,589 | B2 | 4/2012 | Krenceski et al. | |
| 2002/0090856 | A1 | 7/2002 | Weisz-Margulescu | |
| 2003/0044606 | A1 | 3/2003 | Iskander | |
| 2004/0007308 | A1 | 1/2004 | Houston et al. | |
| 2004/0112356 | A1 | 6/2004 | Hatcher | |
| 2004/0222009 | A1 | 11/2004 | Blew et al. | |
| 2005/0042960 | A1 | 2/2005 | Yeh et al. | |
| 2005/0272311 | A1 | 12/2005 | Tsao | |
| 2006/0041922 | A1 | 2/2006 | Shapson | |
| 2006/0154522 | A1 | 7/2006 | Bernhart et al. | |
| 2006/0172571 | A1 | 8/2006 | Montena | |
| 2007/0291462 | A1 | 12/2007 | Peng | |
| 2010/0033001 | A1 | 2/2010 | Boyer | |
| 2010/0276176 | A1 | 11/2010 | Amato | |
| 2011/0011638 | A1 | 1/2011 | Gemme | |
| 2011/0011639 | A1 | 1/2011 | Visser | |

FOREIGN PATENT DOCUMENTS

| | | |
|---|---|---|
| EP | 1075698 | 11/1999 |
| EP | 1335390 | 8/2003 |
| GB | 2079549 | 1/1982 |
| JP | 64002263 | 1/1989 |
| JP | 2299182 | 12/1990 |
| JP | 5347170 | 12/1993 |
| JP | 2004128158 | 4/2004 |
| WO | WO9310578 | 5/1993 |
| WO | WO03013848 | 2/2003 |
| WO | WO2005006353 | 1/2005 |
| WO | WO2011009006 | 1/2011 |
| WO | WO2011146911 | 11/2011 |

OTHER PUBLICATIONS

U.S. Appl. No. 13/111,807, filed May 19, 2011, Youtsey.

U.S. Appl. No. 13/111,817, filed May 19, 2011, Youtsey.

U.S. Appl. No. 13/111,826, filed May 19, 2011, Youtsey.

"F-type connectors", ShowMe Cables, dated 2007 and printed on Jul. 9, 2008, 1 page, located at: http://www.showmecables.com/F-Type-Connectors.html.

Latest quality F-connector Supply Information, China Quality F Connector list, Hardware-Wholesale.com, printed on Jul. 9, 2008, 6 pages, located at: http://www.hardware-wholesale.com/buy-F_Connector/.

"Pico/Macom GRB-I" and "Pico/Macom GRB-2" single and dual coax cable ground blocks, Stallions Satellite and Antenna—Grounding Products, dated Nov. 9, 2005 and printed Aug. 17, 2011, 3 pgs., located online at: http://web.archive.org/web/20051109024213/http://tvantenna.com/products/installation/grounding .html.

* cited by examiner

CONNECTOR WITH A LOCKING MECHANISM AND A MOVABLE COLLET

CROSS REFERENCE TO RELATED APPLICATIONS

The present application claims priority under 35 U.S.C. §119(e) to U.S. Provisional Application No. 61/347,364, filed May 21, 2010; and U.S. Provisional Application No. 61/432,871, filed Jan. 14, 2011; the disclosures of which are incorporated herein by reference if their entireties.

TECHNICAL FIELD

The present technology relates to connectors, such as male cable connectors, that include a locking mechanism to prevent loosening or separation when coupled to a corresponding connector, such as a female connector.

BACKGROUND

Electrical connectors are used in a variety of applications to interconnect electrical circuits and devices. One such connector is the screw-on, threaded F-type connector (or "F-connector"), which is used on most radio frequency (RF) coaxial cables to interconnect TVs, cable TV decoders, VCR/DVD's, hard disk digital recorders, satellite receivers, and other devices. Male F-type connectors are typically attached to the end of a coaxial cable with the central conductor of the coaxial cable extending therefrom. Male F-type connectors (sometimes called the "male connector" or "male F-connector") have a standardized design, generally using a 7/16 inch hex nut as a fastener. The nut has a relatively short (e.g., 1/8 to 1/4 inch) length and can be grasped by a person's fingers to be tightened or loosened.

In order to maintain a tight electrical connection, and to achieve the intended electrical performance, manufacturers and industry standards often require an F-type connector to be tightened to an attachment structure (with respect to F-connectors, these attachment structures are sometimes called the "female connector" or "female F-connector") beyond the torque achievable by using only a person's fingers. In the case of cable TV products, for example, the standard has been to tighten the fastener using a 25 in-lb torque (or to tighten another 90-120 degrees from the finger-tight position). Conversely, consumer products, which have weaker attachment structures (such as plastic), require F-type connector fasteners to be wrench-tightened just slightly beyond finger tight.

A person tightening a fastener by hand may only be able to apply 4-5 in-lbs of torque to an F-connector fastener using his/her fingers, whereas 10-25 in-lbs of torque may be required to properly secure an F-connector fastener to an attachment structure. If a person were, however, to use a wrench to tighten the same fastener, in addition to the wrench being bulky and inconvenient, the person runs the risk of over-tightening the fastener and potentially damaging the attachment structure. Applying too little or too much torque can thus result in increases in returns to the manufacturer, customer service calls, and complaints from consumers.

Furthermore, a number of factors, including vibration and thermal cycling, can cause the threaded connection between the male and female connectors to loosen and/or separate, resulting in signal loss or degradation of electrical performance. Similar issues exist with maintaining the connection between other types of male and female connectors, such as RCA connectors, "plug and socket" connectors, and/or blade connectors.

DETAILED DESCRIPTION

The present disclosure describes connectors with locking mechanisms and associated systems and methods. A connector configured in accordance with an embodiment of the present technology includes a locking mechanism that compresses a male connector inwardly over a female connector, and thereby locks the male and female connectors together to substantially reduce signal loss or degradation of electrical performance caused by a loose connection. The connector can be configured to engage threaded and/or unthreaded surfaces. Additionally, the connector can reduce or prevent damage to electronic components caused by over-tightening the connector. Certain details are set forth in the following description and in FIGS. 1-16 to provide a thorough understanding of various embodiments of the disclosure. Other details describing well-known structures and systems often associated with connectors, coaxial cables, etc., have not been set forth below to avoid unnecessarily obscuring the description of the various embodiments of the disclosure.

Many of the details, dimensions, angles and other features shown in FIGS. 1-16 are merely illustrative of particular embodiments of the disclosure. Accordingly, other embodiments can add other details, dimensions, angles and features without departing from the spirit or scope of the present technology. In addition, those of ordinary skill in the art will appreciate that further embodiments of the technology can be practiced without several of the details described below.

Figure 1:
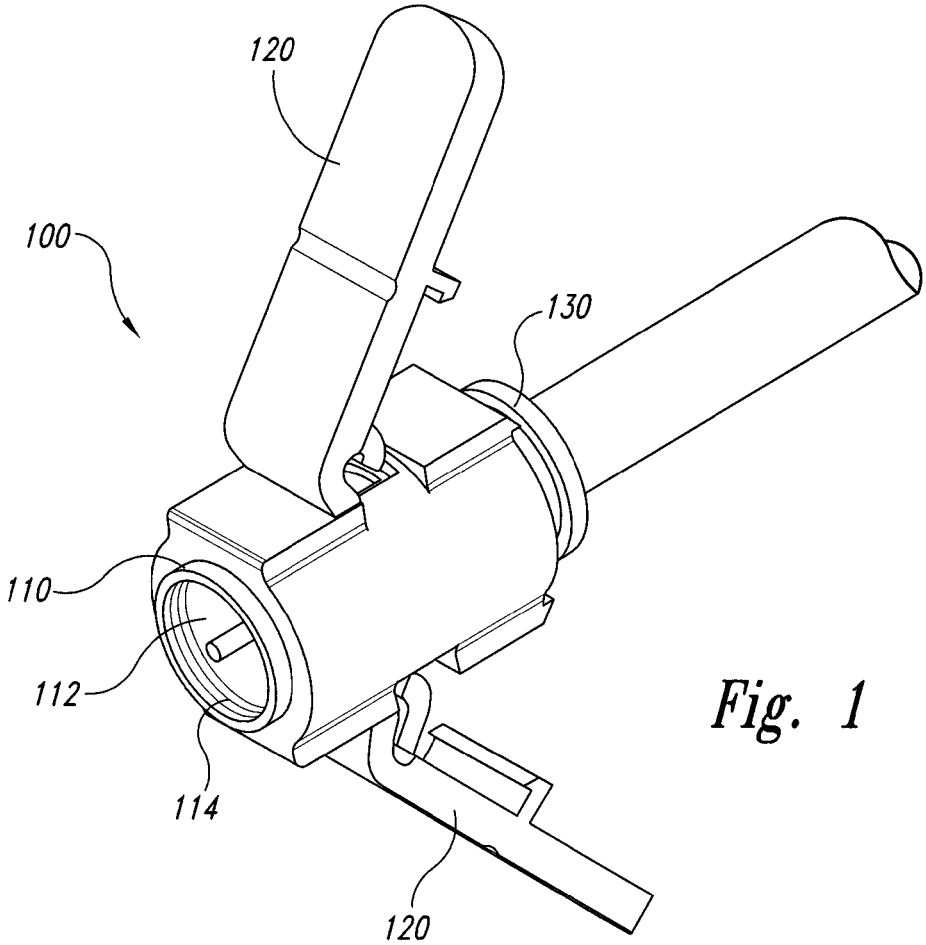
FIG. 1 is an isometric view of a male connector with a locking mechanism in an "open" position and configured in accordance with an embodiment of the present technology.
Figure 2:
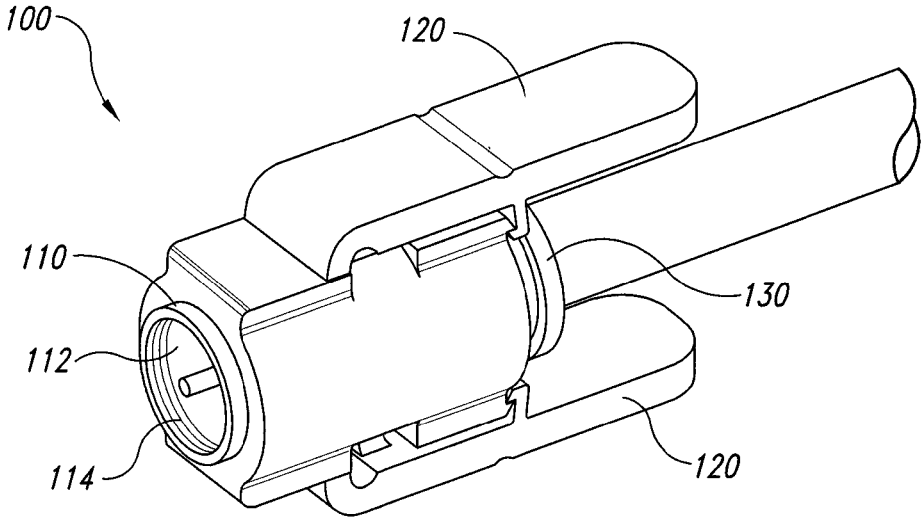
FIG. 2 is an isometric view the male connector of FIG. 1 with the locking mechanism in a "closed" position.

An exemplary first connector 100 (e.g., a male F-type connector; previously referred to as a "female" F-type connector in related provisional application No. 61/347,364) according to aspects of the present technology is depicted in FIGS. 1 and 2. Connector 100 includes a collet 110 and locking mechanism 120. The collet 110 includes an inner surface 112 defining a bore for receiving a second or female connector. In this exemplary embodiment, the inner surface 112 includes threads 114 for engaging corresponding threads on a female F-type connector. In other embodiments, however, all or portions of the inner surface 112 of the collet 110 can be smooth. In the illustrated embodiment, the locking mechanism 120 includes a pair of latches, which are shown extended (i.e., in an open position) to allow the connector 100 to be released from the female connector in FIG. 1. In FIG. 2, the locking mechanism 120 is shown in the "locked" position (i.e., the latches are retracted) to secure the collet 110 to the female connector.

In alternate embodiments, the connector may be a female connector configured to securely engage a corresponding male connector. In another embodiment, for example, an RCA plug (a male connector) includes a locking mechanism to secure it to a corresponding female RCA connector.

The collet 110 may be any size, shape, or configuration to interface with a mating connector (such as a corresponding female connector). As stated previously, in some embodiments of the present technology, the collet 110 may be part of a male connector other than an F-type male connector, and configured to interface with a corresponding female connector (such as in the case of an RCA connector, USB connector, or other connector where a male plug on a cable is joined with a female socket). The collet 110 may be formed from any suitable material. In one embodiment, for example, the collet 110 is at least partially formed from a metal, such as brass, copper, steel, stainless steel, aluminum, metalized composite plastic, etc. In one embodiment, the collet 110 is formed from a material that is both deformable (to compress against the female connector when the locking mechanism 120 is in the locked position) and resilient (to substantially return to its shape before compression when the locking mechanism 120 is in the open position). In the exemplary embodiment depicted in FIGS. 1 and 2, a user can slip the connector 100 over a female connector and lock the locking mechanism 120 to achieve a connection with the intended electrical performance while avoiding the issues of over-tightening and under-tightening of conventional screw-on F-type connectors.

The collet 110 includes an inner surface 112 defining a bore for receiving the mating connector (e.g., a corresponding female connector). In the exemplary embodiment depicted in FIGS. 1 and 2, the inner surface 112 is partially threaded. In this embodiment, the distal end of the inner surface 112 (i.e., the end at which the female connector is received) is threaded (with two rows of threads), while the rest of the inner surface 112 of the collet 110 is threadless. Among other things, the partial threading allows the female connector to be inserted easily into the collet 110, while still allowing the threads 114 to engage mating threads on the female connector to enhance the connection with the female connector when the locking mechanism 120 is locked. In one embodiment, the collet 110 is configured such that the threads 114 do not engage the threads on the female connector at all until the locking mechanism 120 is moved to the locked position. In other embodiments, all or portions of the threads 114 can be omitted to facilitate insertion of the female connector into the collet 110 (e.g., prevent threads from catching on one another during insertion of the female connector). In further embodiments, the collet 110 can be configured to engage an unthreaded portion of the female connector.

The bore defined by the inner surface 112 may be any size, shape, and configuration to interface with a corresponding mating (e.g., female) connector. In one embodiment, the bore is substantially cylindrical. In another embodiment, the bore is tapered. The bore can be tapered in any manner. For example, the bore may be tapered such that the diameter of the bore at the distal end of the collet 110 (i.e., where the female connector is inserted) is smaller than the diameter of the bore at the proximal end of collet 110. Among other things, the tapering of the bore helps secure the collet 110 to the female connector when the locking mechanism 120 is in the locked position. The outer surface of the collet 110 may also be of any size, shape, and configuration. For example, the collet 110 may be cylindrical or tapered to match the taper of the bore. However, the size, shape, or configuration of the outer surface of the collet 110 may be independent of the size, shape, or configuration of the bore. For example, the outer surface of the collet 110 may be cylindrical, while the inner bore is tapered.

The locking mechanism 120 is configured to engage the collet 110 to secure the collet 110 to the female connector. The locking mechanism 120 may be include any device configurable to secure the collet 110 to the female connector, including a latch, hook, snap, clasp, and/or clamp. The locking mechanism 120 may be configured to be manipulated between its open and locked positions by a human hand, by a tool, or both.

Figure 3:
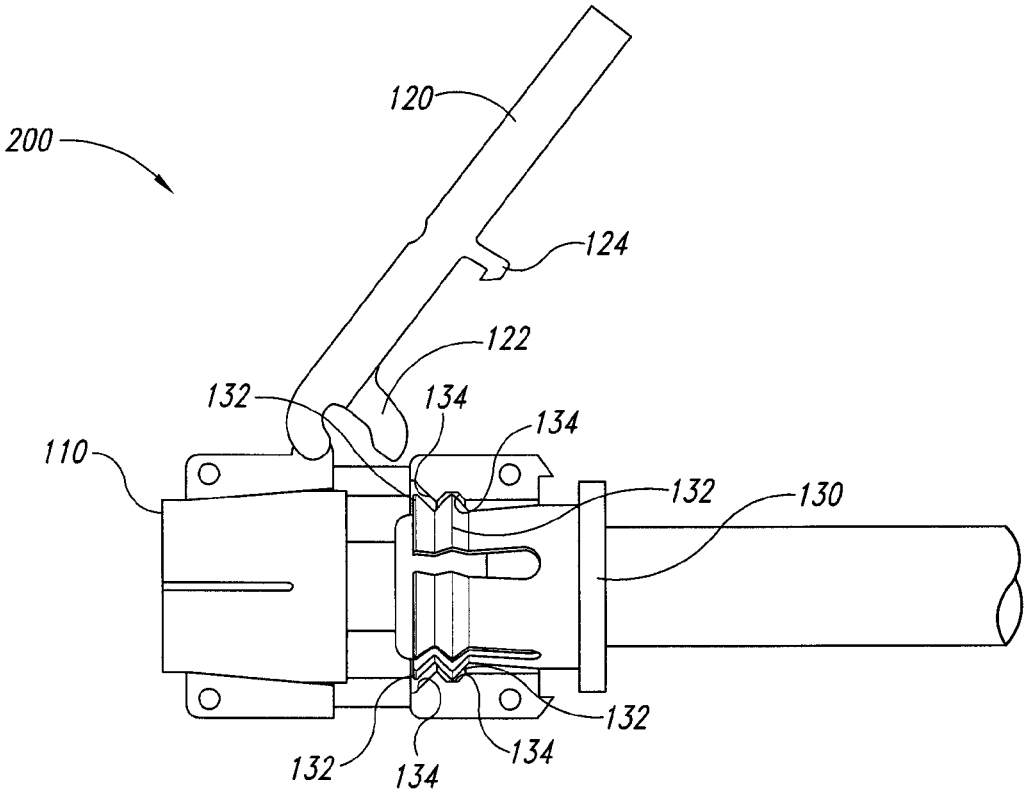
FIGS. 3-6 are side, cut-away views of male connectors configured in accordance with embodiments of the present technology.
Figure 4:
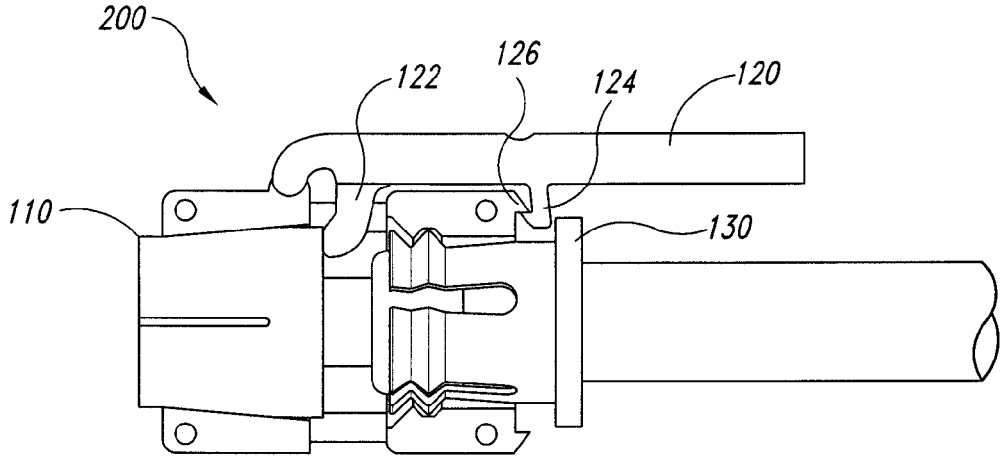

FIGS. 3 and 4 depict a cutaway view of an exemplary connector 200 (e.g., a male F-connector; previously referred to as a "female" connector in related provisional application No. 61/347,364) wherein the locking mechanism is a single latch 120, which pivots between its open position (shown in FIG. 3) and its locked position (shown in FIG. 4). In this embodiment, the latch 120 pivots toward the rear (proximal end) of the connector 200 as it is moved into the locked position, though, in alternate embodiments, the latch 120 may be configured to pivot towards the front (distal end) of the connector 200 or be manipulated in any other suitable manner. In this embodiment, when the locking mechanism 120 is moved into its locked position, it applies pressure to the rear of the collet 110, thereby compressing the collet 110 against the female connector. In various embodiments, the inner surface of the collet 110 can include threads that can grip exterior threads on the female connector. In other embodiments, the collet 110 can have a smooth interior surface that can grip threaded and/or unthreaded surfaces of the female connector. Regardless of whether the collet 110 is threaded, the locking mechanism 120 can compress the collet 110 inwardly to engage the female connector without requiring the connectors to be screwed together. When the locking mechanism 120 is moved from its locked position to its open position, it releases the pressure on the collet 110, allowing the connector 200 to be removed from the male connector.

In this exemplary embodiment, the locking mechanism 120 includes a first portion 122 configured to engage the collet 110 when the locking mechanism 120 is moved to its locked position. A second portion 124 of the latch 120 is configured to hold the latch 120 in the locked position until a user moves the latch 120 back into the open position. In this embodiment, the second portion 124 is a hook that engages a corresponding hook 126 on the body of the connector 200 to hold the locking mechanism 120 in the locked position.

Among other things, this prevents unwanted loosening of the male connector 200 from the female connector due to thermal cycling, vibration and/or stress on the cable to which the connector 200 is attached.

The locking mechanism 120 and body of the connector 200 may be formed from any suitable materials. In the exemplary embodiment depicted in FIGS. 3 and 4, the locking mechanism 120 is made of plastic, such as polyethylene or other suitable plastic.

Figure 6:
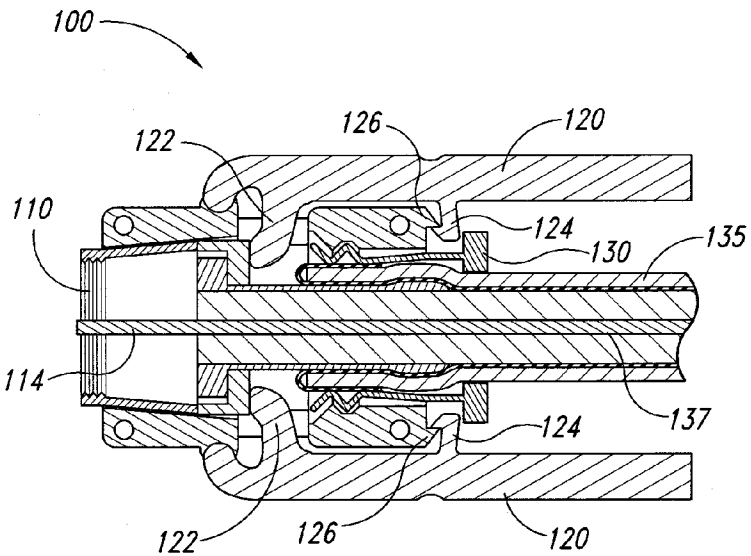
Figure 5:
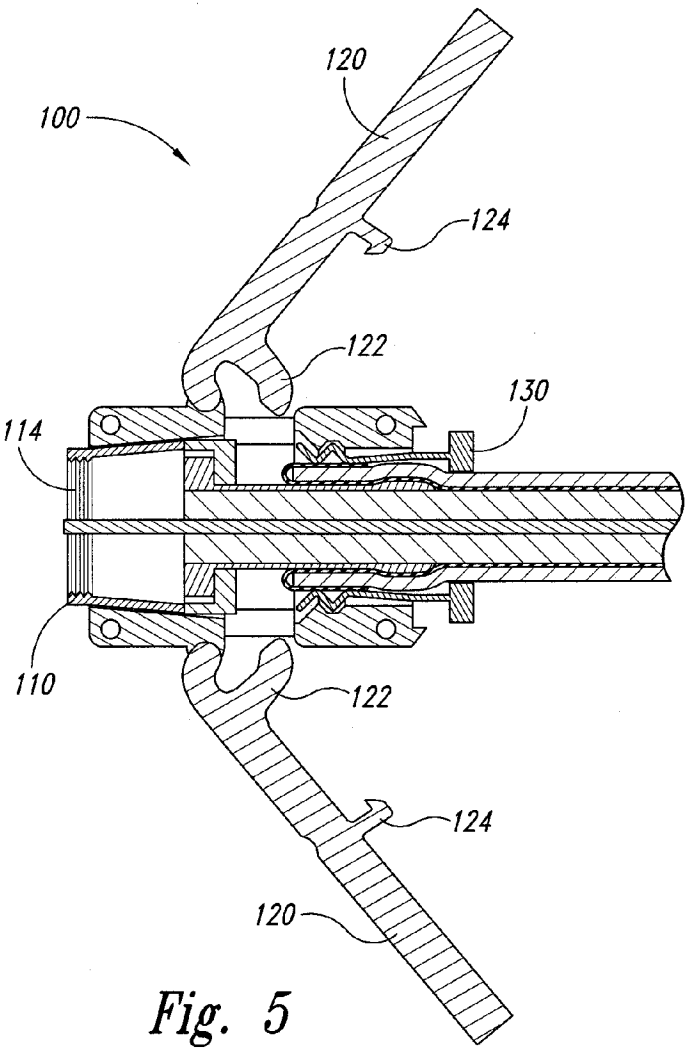

In another exemplary embodiment, referring now to FIGS. 5 and 6, connector 100 includes a pair of latches 120 for engaging the collet 110. In FIG. 5, both latches 120 are their open positions, while both latches 120 are in their locked position in FIG. 6. In this embodiment, the collet 110 is configured to fit over an F-type connector and both latches 120 are moved to their locked position to secure the male connector 200 to the female connector.

Connectors 100 and 200 may be attached to a cable 135 in any suitable manner. In one exemplary embodiment, as best seen in FIG. 3, connectors 100 and 200 attach to cable 135 via retainer 130, which is described in U.S. Pat. No. 6,648,683 as "retainer 40." U.S. Pat. No. 6,648,683 is incorporated herein in its entirety by reference. In this embodiment, ridges 132 on the retainer 130 interface with grooves 134 on the connector (100, 200) to attach the connector (100, 200) to the cable 135.

Figure 7:
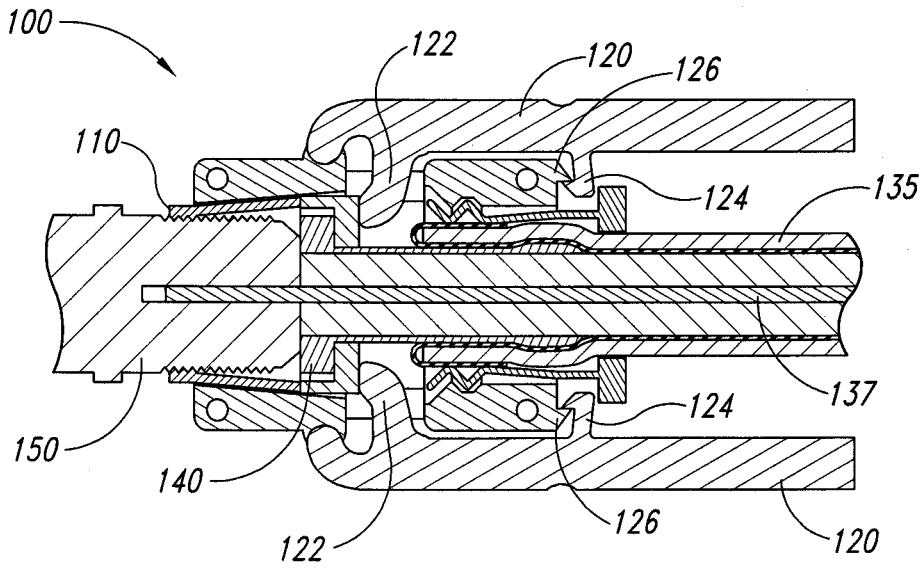
FIGS. 7 and 8 are side, cut-away views of a male connector attached to a female connector in accordance with an embodiment of the present technology.
Figure 8:
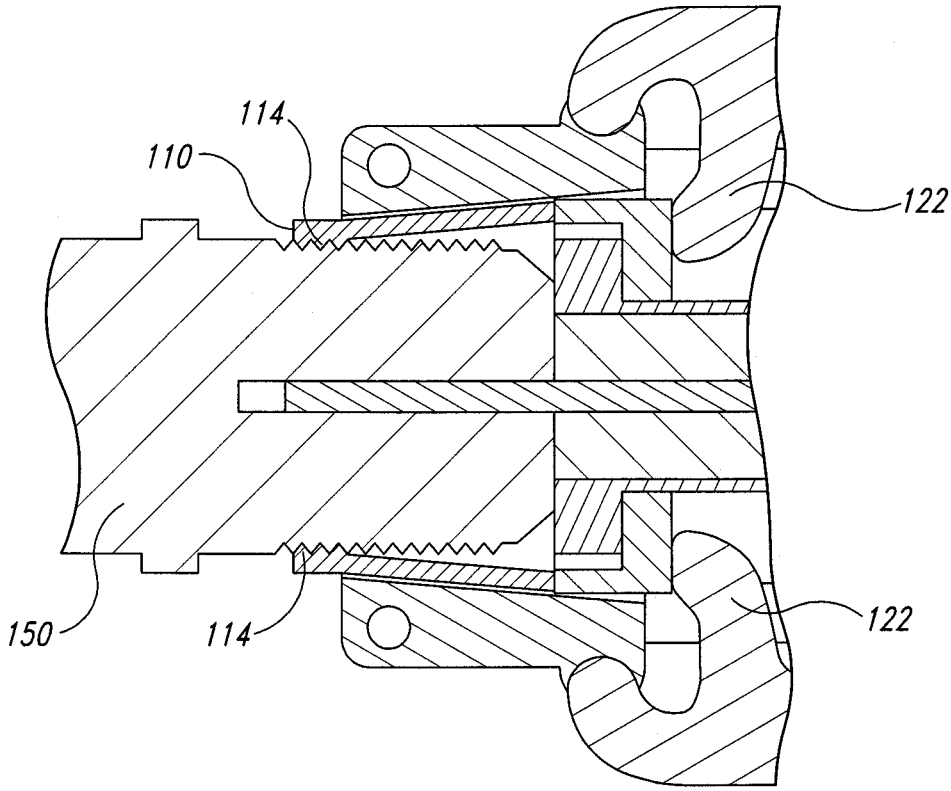

FIGS. 7 and 8 depict connector 100 attached to a female F-type connector 150. As shown, center conductor 137 of cable 135 is inserted into the female connector 150. Latches 120 are both in their locked position. Portions 122 apply pressure to the rear of collet 110, compressing it (and conductive insert 140, which is in communication with the collet 110) against the female connector 150, while portions 124 interact with portions 126 to hold the latches 120 in the locked position.

Figure 9B:
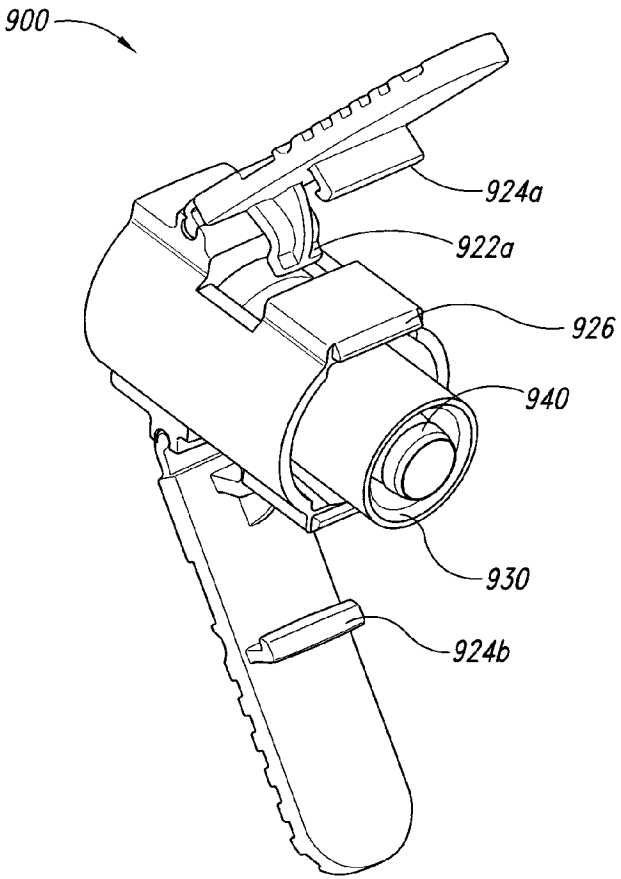
FIGS. 9A and 9B are front and rear isometric views, respectively, of a connector configured in accordance with another embodiment of the present technology having a locking mechanism in an "open" position.
Figure 9A:
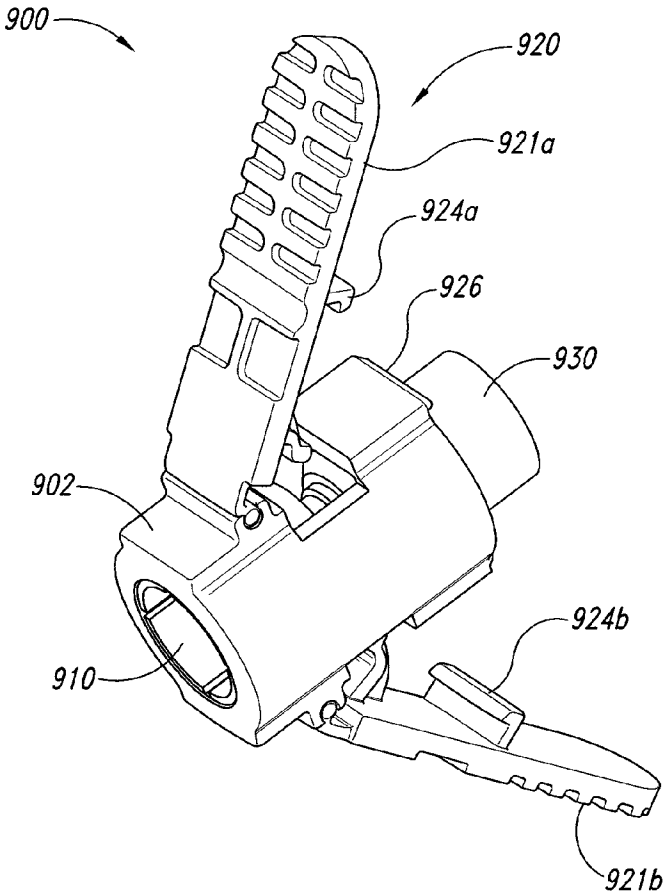

FIGS. 9A and 9B are front and rear isometric views, respectively, of a connector 900 (e.g., a male F-connector) configured in accordance with another embodiment of the present technology. Many features of the connector 900 are at least generally similar in structure and function to corresponding features of the connectors 100 and 200 described in detail above. For example, in the illustrated embodiment the connector 900 includes a locking mechanism 920 having a first latch 921*a* and a second latch 921*b* pivotally coupled to a connector body 902. In FIGS. 9A and 9B, the locking mechanism 920 is illustrated in an "open" position with the latches 921 rotated away from the connector body 902.

As illustrated to good effect in FIG. 9B, the connector 900 also includes a conductive insert 940 disposed within a retainer 930. As described in greater detail below, the retainer 930 and the conductive insert 940 are configured to operably engage an end portion of a coaxial cable. As with the connectors 100 and 200 described above, the connector 900 also includes an engagement sleeve or collet 910 configured to slip over and engage a corresponding mating connector (e.g., a mating female connector; not shown) when the latches 921 are moved to the "closed" position. Each of the latches 921 includes a driving portion 922 and a locking portion 924. As described in greater detail below, the driving portions 922 are configured to drive the collet 910 forward relative to the connector body 902 as the latches 921 are moved to the "closed" position. The locking portions 924 can include hooks or other engagement features configured to engage edges 926 or other suitable features on the connector body 902 to hold the latches 921 in the "closed" position.

Figure 10A:
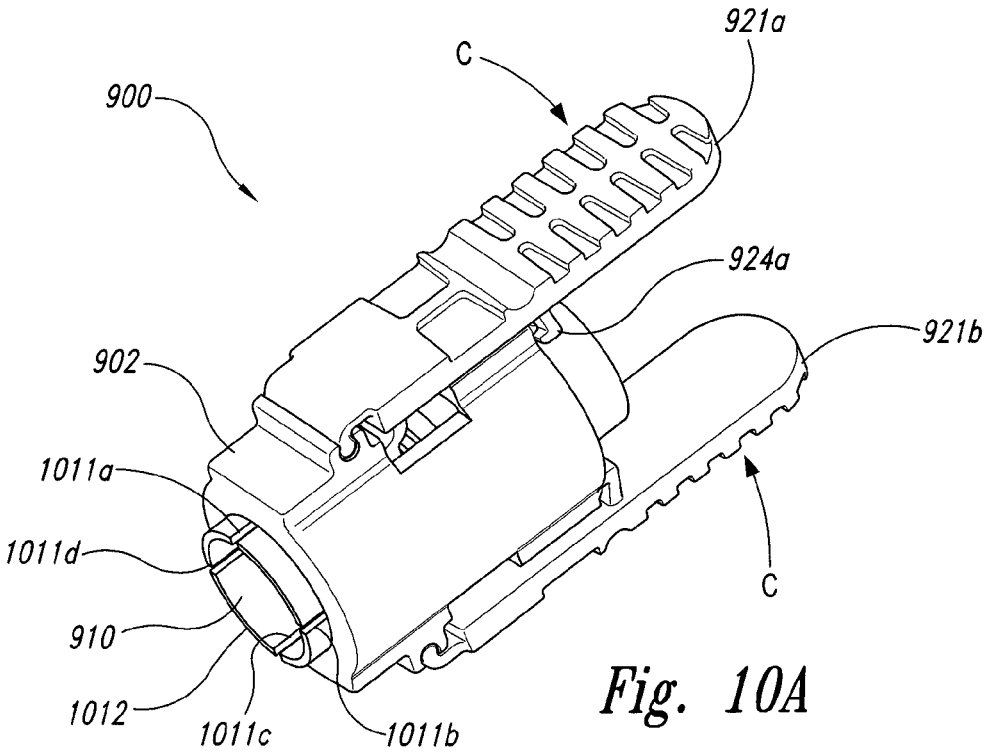
FIGS. 10A and 10B are front and rear isometric views, respectively, of the connector of FIGS. 9A and 9B with the locking mechanism in a "closed" position.
Figure 10B:
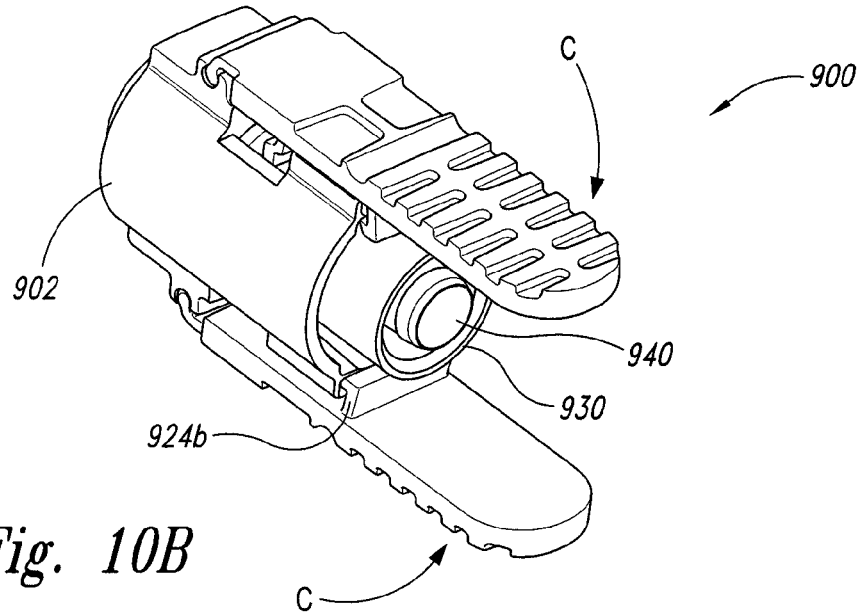

FIGS. 10A and 10B are front and rear isometric views, respectively, of the connector 900 with the latches 921 in the "closed" position. As shown in FIG. 10A, the collet 910 can include one or more slots 1011 that extend through the sidewall of the collet 910. More specifically, in the illustrated embodiment the collet 910 includes four slots 1011*a-d* positioned at 90 degree intervals around the circumference of the collet 910. The slots 1011 extend inwardly from a front edge or distal end 1012 of the collet 910 (e.g., the edge that slips over the mating connector) toward the rear of the collet 910. As described in greater detail below, the slots 1011 enable the collet 910 to contract inwardly around a mating connector and grasp the connector when the latches 921 are moved toward the "closed" position in direction C. As shown in FIG. 10B, the locking portions 924 of the latches 921 engage the edges 926 (FIG. 9B) of the connector body 902 to secure the latches 921 in the "closed" position. When desired, a user can release the latches 921 from the closed position by prying outwardly on the latches 921 with sufficient force.

Figure 11A:
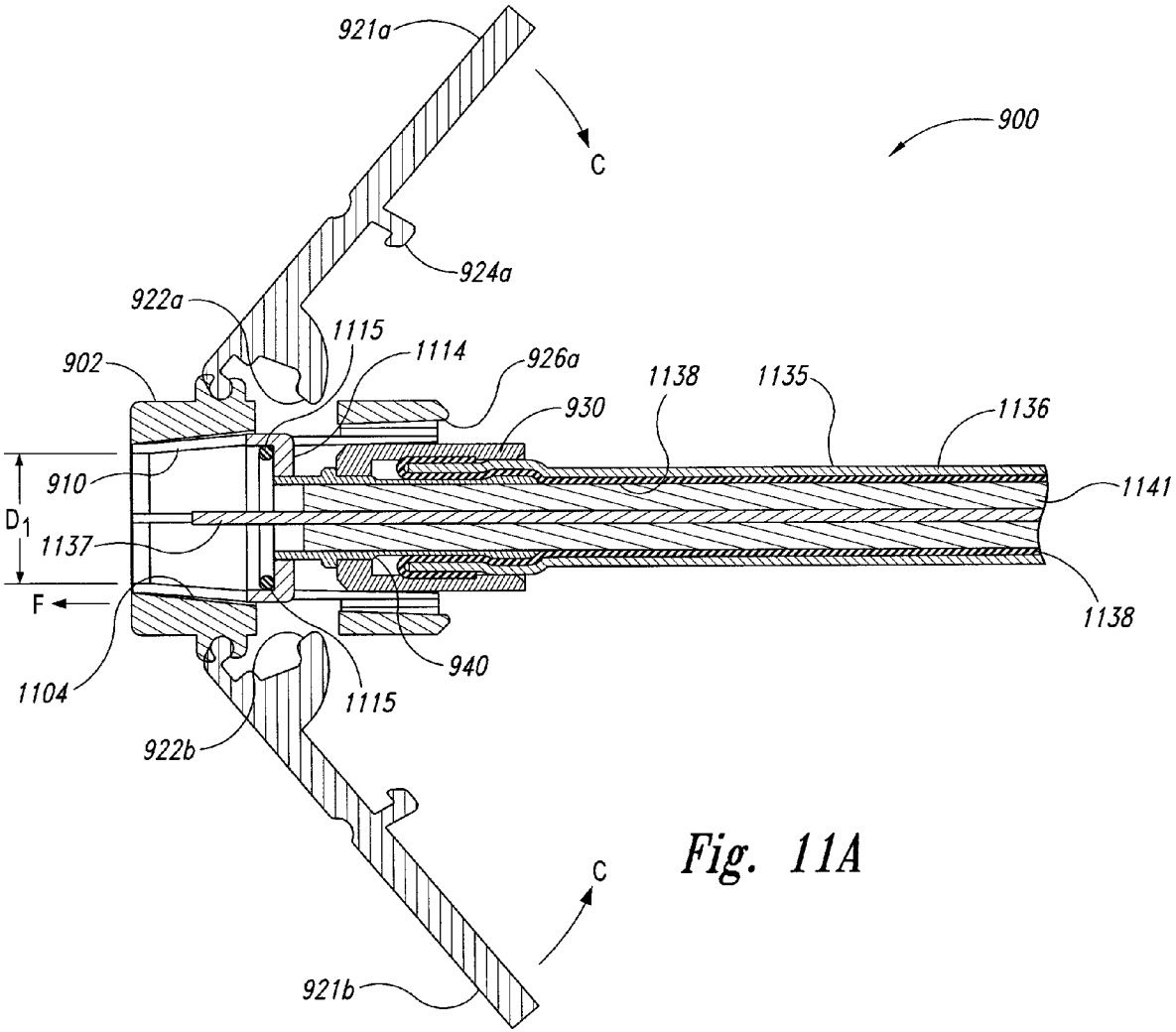
FIG. 11A is a side cross-sectional view of the connector of FIGS. 9A-10B with the locking mechanism in the "open" position.
Figure 11B:
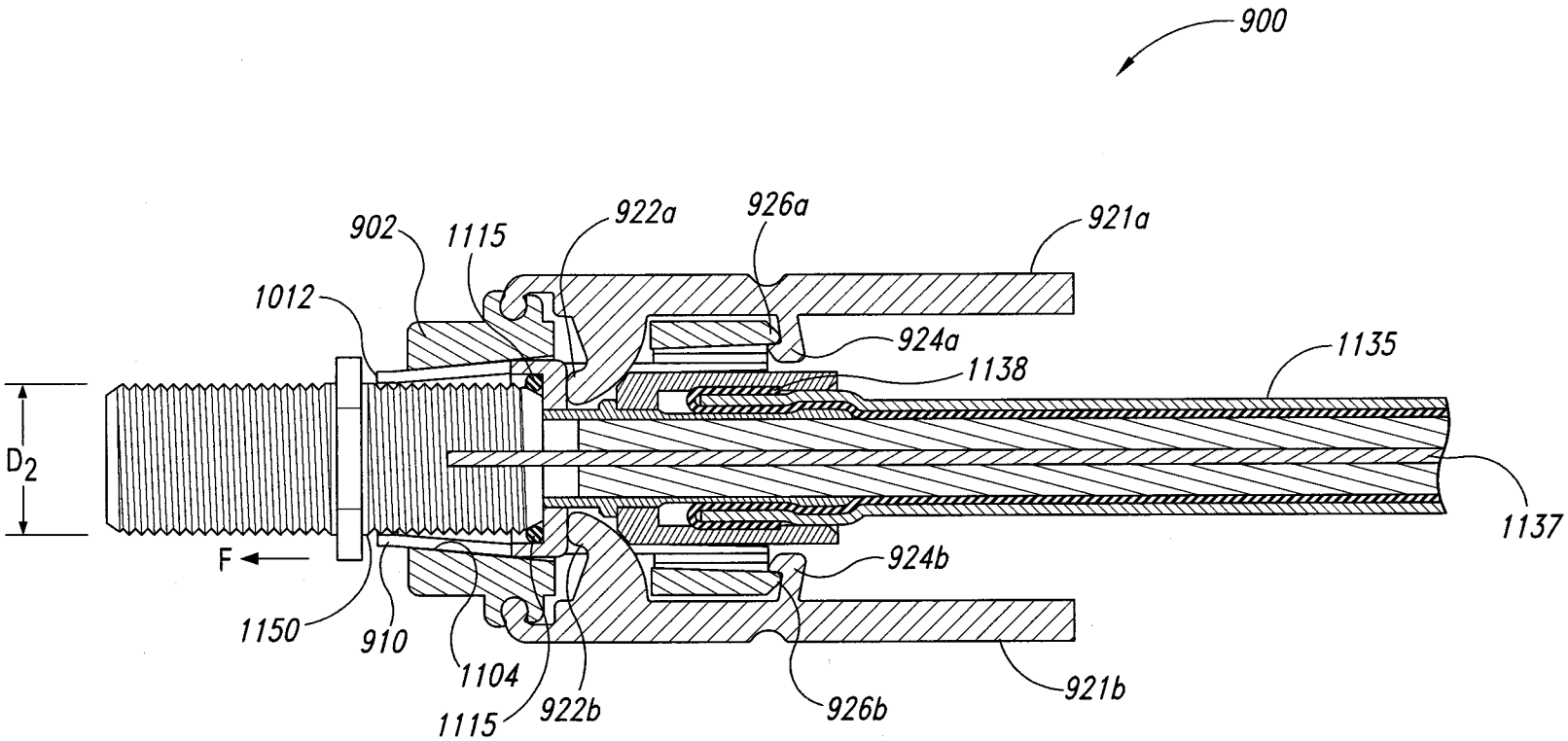
FIG. 11B is a side cross-sectional view of the connector with the locking mechanism in the "closed" position.

FIGS. 11A and 11B are side cross-sectional views of the connector 900 in the "open" and "closed" positions, respectively. Referring first to FIG. 11A, in the illustrated embodiment an end portion of a cable 1135 (e.g., a coaxial cable) is operably engaged with the connector 900. More specifically, the cable 1135 includes a central conductor 1137 (e.g., a copper clad solid steel conductor) extending through a dielectric layer 1141 (e.g., a foam dielectric layer). The dielectric layer 1141 is covered with a braided sheath 1138 (e.g., a braided aluminum wire sheath) which is in turn covered by an outer jacket 1136 (e.g., a polyvinylchloride or polyethylene jacket). To operably attach the cable 1135 to the connector 900, the dielectric layer 1141 is cut back so that the central conductor 1137 protrudes outwardly therefrom. The cable jacket 1136 is then cut back from the end of the dielectric layer 1141, and the braided sheath 1138 is folded back over the outer edge of the jacket 1136. The dielectric layer 1141 is then inserted into the conductive insert 940 so that the braided sheath 1138 slips over the outside of the conductive insert 940. This results in the end portion of braided sheath 1138 and the jacket 1136 being received in the space between the inner surface of the retainer 930 and the outer surface of the conductive insert 940, as shown in FIG. 11A.

Referring to FIGS. 11A and 11B together, the connector 900 can be used to operably connect the cable 1135 to a mating connector 1150 (e.g., a corresponding female F-connector) on an electronic device (not shown) in one embodiment as follows. With the latches 921 in the open position illustrated in FIG. 11A, the collet 910 is slipped over the mating connector 1150 (FIG. 11B) so that the tip of the central conductor 1137 is suitably received by and/or connected to the mating connector 1150. The latches 921 are then rotated inwardly in direction C toward the "closed" position. As the latches 921 rotate inwardly, the driving portions 922 come to bear against a rear surface portion 1114 of the collet 910 and drive the collet 910 forward in direction F with respect to the connector body 902. In various embodiments, the connector 900 can include a sealing feature 1115 at the proximal end portion of the collet 910 that seals the interface between the collet 910 and the mating connector 1150. The sealing feature 1115 can be an O-ring as shown in FIGS. 11A and 11B, or can include other types of sealing features known to those skilled in the art.

As shown in FIG. 11A, the collet 910 is movably received in a bore 1104 in the connector body 902. In the illustrated embodiment, the bore 1104 is tapered inwardly toward the direction F. As a result, when the driving portions 922 of the latches 921 drive the collet 910 forward in the tapered bore 1104, the slots 1011 in the collet 910 (FIG. 10A) enable the distal end 1012 of the collet 910 to contract inwardly from a first diameter $D_1$ (FIG. 11A) to a smaller second diameter $D_2$ (FIG. 11B). As with the connectors 100 and 200 described above, the inner surface of the collet 910 can include one or more threads and/or similar features at or near the distal end 1012 to engage corresponding threads on the mating connector 150. The contraction of the distal end 1012 of the collet 910 enables the collet 910 to firmly grasp the mating connector 1150 while avoiding the issues of over-tightening and under-tightening associated with conventional screw-on F-type connectors.

Figure 12A:
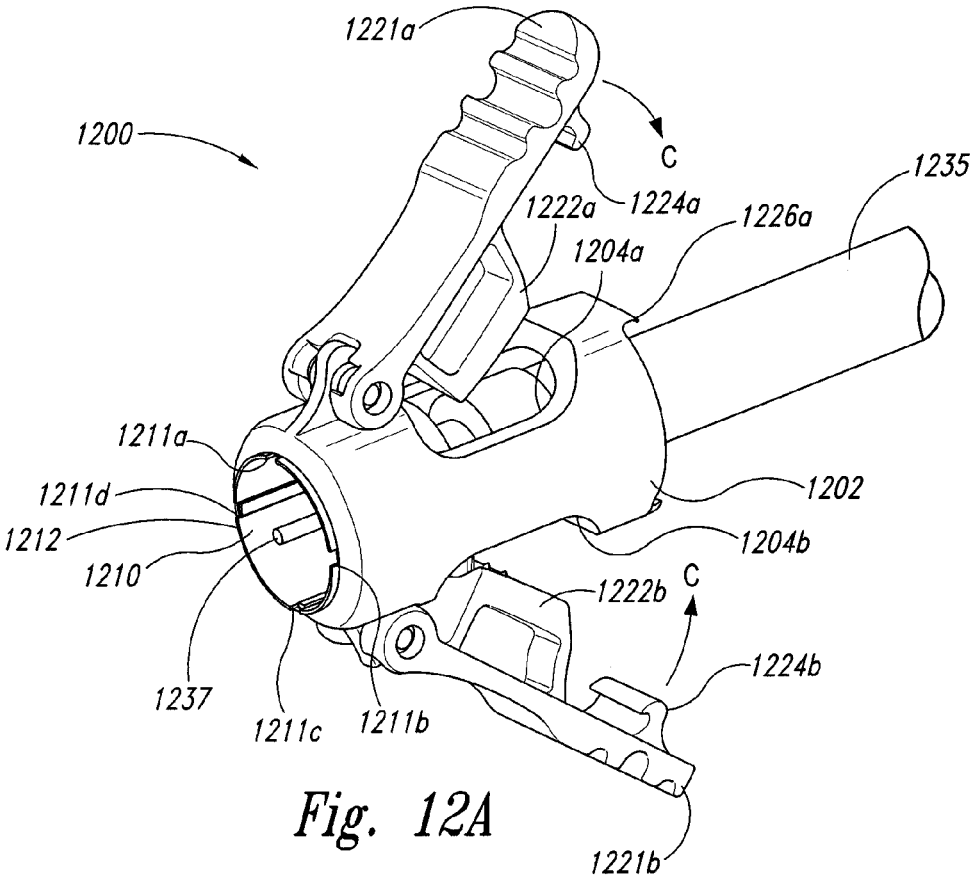
FIGS. 12A and 12B are isometric views of a connector having a locking mechanism in an "open" position and a "closed" position, respectively, and configured in accordance with a further embodiment of the present technology.
Figure 12B:
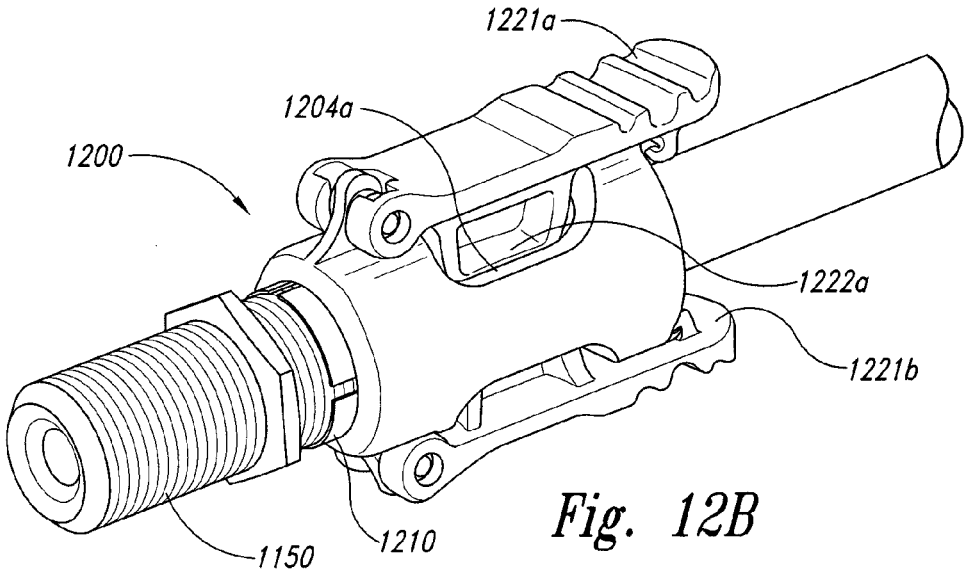

FIGS. 12A and 12B are front isometric views of a connector 1200 (e.g., a male F-connector) configured in accordance with another embodiment of the present technology. The connector 1200 is shown in an "open" position in FIG. 12A, and in a "closed" position engaged with a mating connector 1150 (e.g., a female F-connector) in FIG. 12B. Many features of the connector 1200 are at least generally similar in structure and function to corresponding features of the connectors 100, 200 and 900 described in detail above. For example, referring first to FIG. 12A, the connector 1200 includes a connector body 1202 that receives an end portion of a cable 1235 (e.g., a coaxial cable). The cable 1235 includes a central conductor 1237 that protrudes through a collet 1210. The collet 1210 is movably received in a tapered bore in the connector body 1202, and is at least generally similar in structure and function to the collet 910 described in detail above.

The connector 1200 also includes a first latch 1221*a* and a second latch 1221*b* which are pivotally coupled to the connector body 1202 adjacent openings 1204*a, b*. In the illustrated embodiment, the latches 1221*a* and 1221*b* are identical, or at least substantially identical to each other. Each of the latches 1221 includes a driving portion 1222 and a locking portion 1224. As with the connector 900 described above, the driving portions 1222 are configured to drive the collet 1210 forward in the connector body 1222. As the collet 1210 moves forward, a plurality of slots 1211*a-d* in the collet 1210 (FIG. 12A) enable a distal end 1212 of the collet 1210 to contract inwardly and clamp on to the mating connector 1150 (FIG. 12B). The locking portions 1224 of the latches 1221 can engage edges 1226 or other engagement features on the connector body 1202 to hold the latches 1221 in the "closed" position with the connector 1200 firmly attached to the mating connector 1150.

Figure 13A:
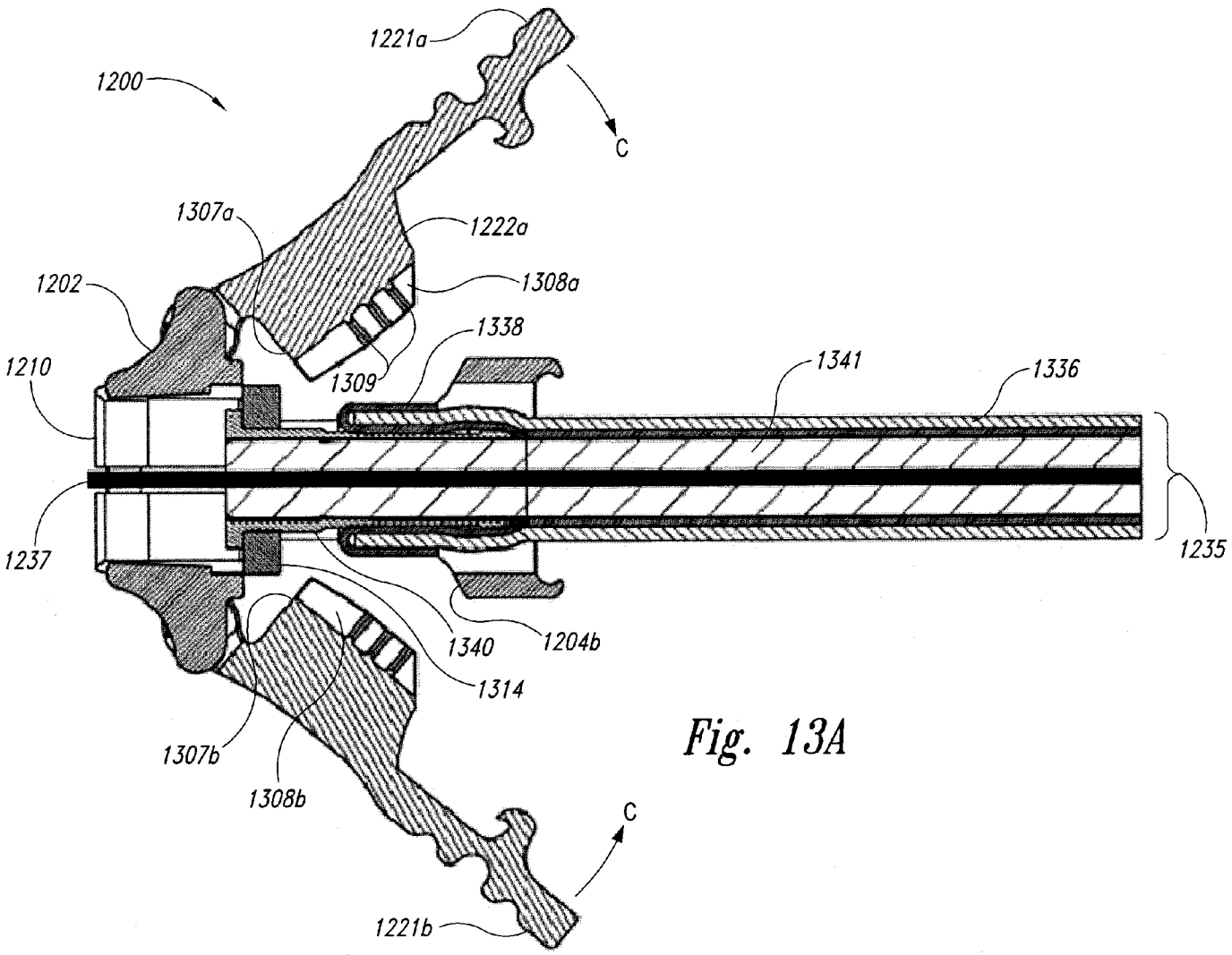
FIG. 13A is a side cross-sectional view of the connector of FIGS. 12A and 12B with the locking mechanism in the "open" position.
Figure 13B:
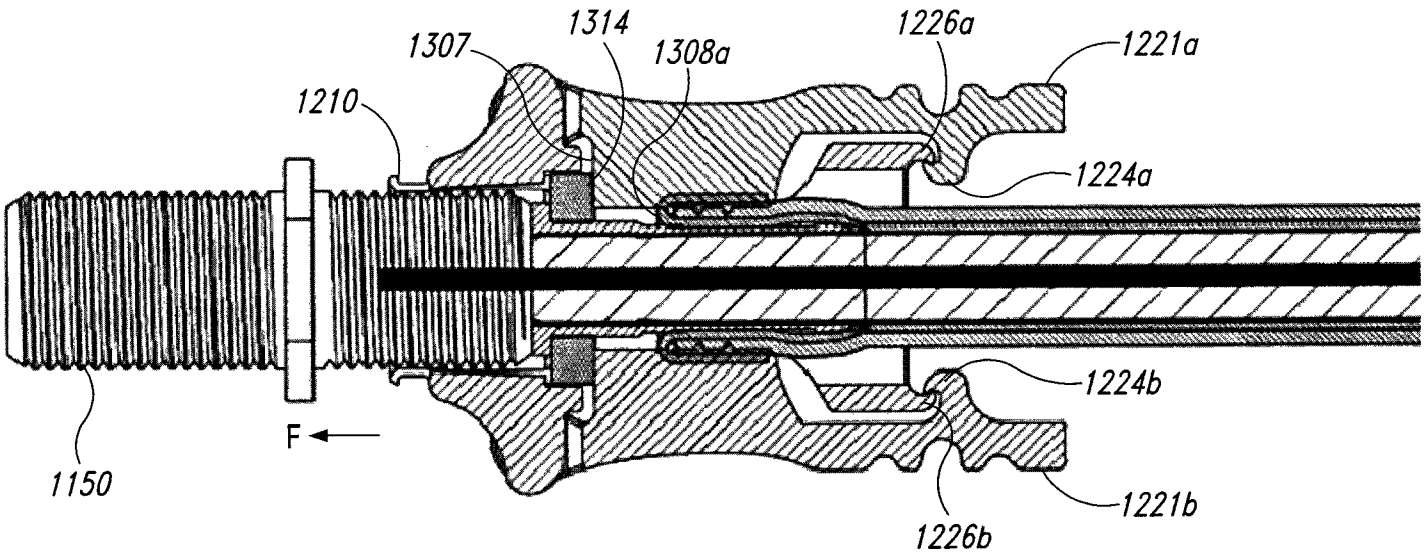
FIG. 13B is a side cross-sectional view of the connector with the locking mechanism in the "closed" position.

FIGS. 13A and 13B are side cross-sectional views of the connector 1200 in the "open" and "closed" positions, respectively. In the illustrated embodiment, the cable 1235 is at least generally similar to the cable 1135 described in detail above. Accordingly, the cable 1135 includes a dielectric layer 1341 (e.g., a foam dielectric layer) that surrounds the central conductor 1237. The dielectric layer 1341 is covered by a braided sheath 1338 which is in turn covered by an outer jacket 1336. The outer jacket 1336 is cut back away from the end portion of the cable 1235 as shown in FIG. 13A, and then the braided sheath 1338 is pulled away from the end portion of the dielectric layer 1341 and folded back over the jacket 1336. The dielectric layer 1341 is then inserted into a conductive insert 1340 so that the braided sheath 1338 slips over the outside of the conductive insert 1340. The conductive insert 1340 can include one or more circumferential barbs or other known features for engaging the braided sheath 1338 and retaining the cable 1235.

Although the connector 1200 is structurally and functionally similar to the connectors described above, in the illustrated embodiment the driving portions 1222 of the latches 1221 include both a driving surface 1307 and a clamping surface 1308. When the latches 1221 are moved inwardly in direction C toward the "closed" position, the driving surfaces 1307 contact a rear surface portion 1314 of the collet 1210 and drive the collet 1210 forward in direction F to clamp the collet 1210 on to the connector 1150 (FIG. 13B). At the same time, the clamping surfaces 1308 contact the exposed portion of the braided sheath 1338 and clamp the cable 1235 therebetween, as shown in FIG. 13B. The clamping surfaces 1308 can include concave cylindrical surfaces sized and shaped to fit tightly around the cable 1235 when the latches 1221 are in the "closed" position. In addition, the clamping surfaces 1308 can include one or more ridges, ribs or similar features 1309 to help grip the cable 1335.

Accordingly, in the illustrated embodiment the driving portions 1222 perform two functions: they drive the collet 1210 forward to engage the collet 1210 with the mating connector 1150, and they squeeze the cable 1235 to help secure the cable 1235 to the connector 1200. One benefit of this particular embodiment is that the connector 1200 does not need a cable retainer, such as the retainer 930 described above.

Figure 14:
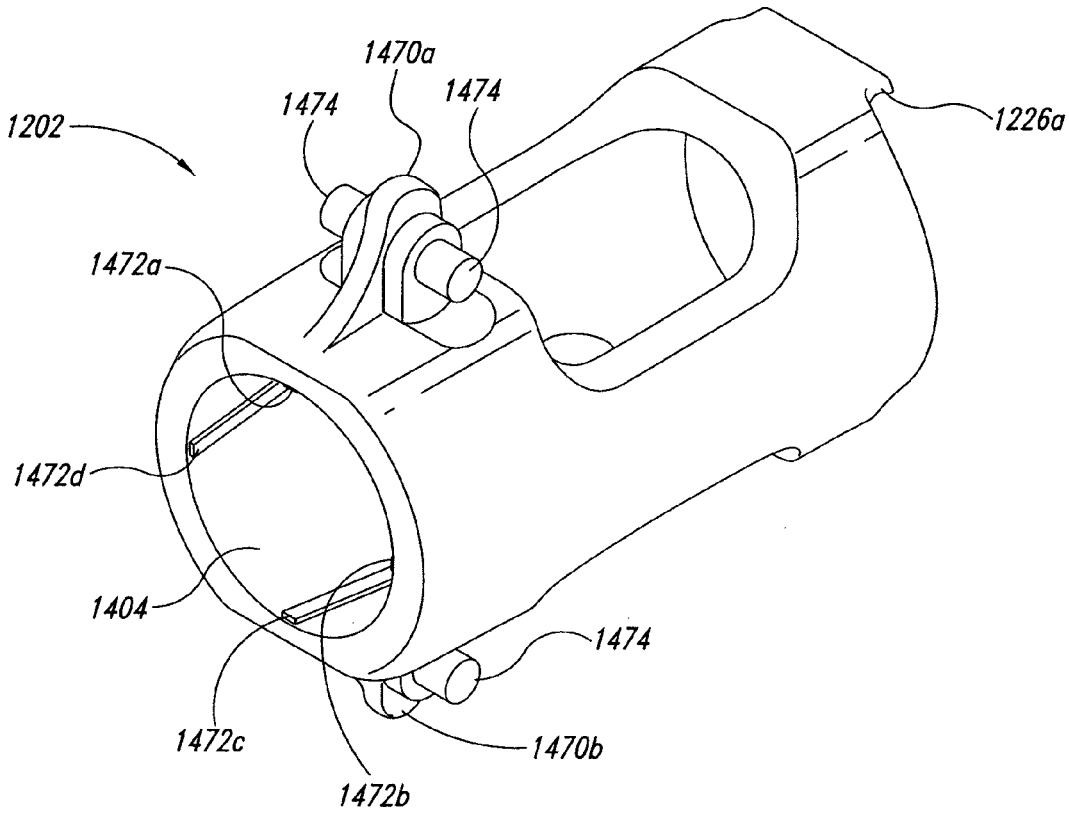
FIG. 14 is an enlarged isometric view of a connector body configured in accordance with the present technology.

FIG. 14 is an enlarged isometric view of the connector body 1202 illustrating various features in more detail. As this view illustrates, the connector body 1202 includes a tapered bore 1404 that slidably receives the collet 1210 (FIG. 12A). The bore 1404 can include a plurality of guide features 1472*a-d* protruding inwardly from the surface thereof. The guide features 1472 can be in the form of ridges, rails and/or other raised features that are received in the slots 1211 of the collet 1210 (FIG. 12A). The guide features 1472 prevent the collet 1210 from rotating appreciably with respect to the body 1202, but allow the collet 1210 to slide back and forth in the bore 1404 as the latches 1221 move between the "open" and "closed" positions. In other embodiments, the guide features 1472 can be omitted and replaced with one or more recesses or guide channels in the surface of the bore 1404. The guide channels can receive corresponding guide features (e.g., protrusions) on the collet 1210 to maintain proper orientation of the collet 1210 during operation.

The connector body 1202 also includes a first attachment feature 1470*a* and the second attachment feature 1470*b*. In the illustrated embodiment, each attachment feature 1470 includes opposing cylindrical pin portions 1474. The pin portions 1474 can be received in corresponding sockets on the latches 1221 (FIGS. 12A and 12B) to pivotally couple the latches 1221 to the connector body 1202. In other embodiments, the connector body 1202 can include other suitable features for pivotal attachment of the latches 1221.

Figure 15A:
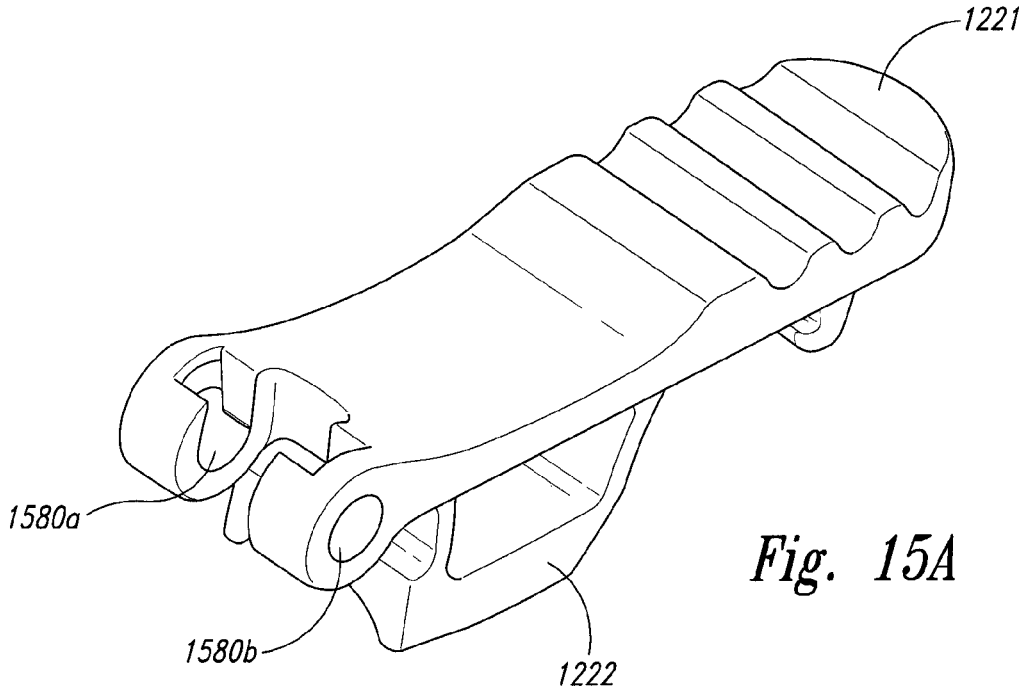
FIGS. 15A and 15B are enlarged top and bottom isometric views, respectively, of a portion of a locking mechanism configured in accordance with the present technology.
Figure 15B:
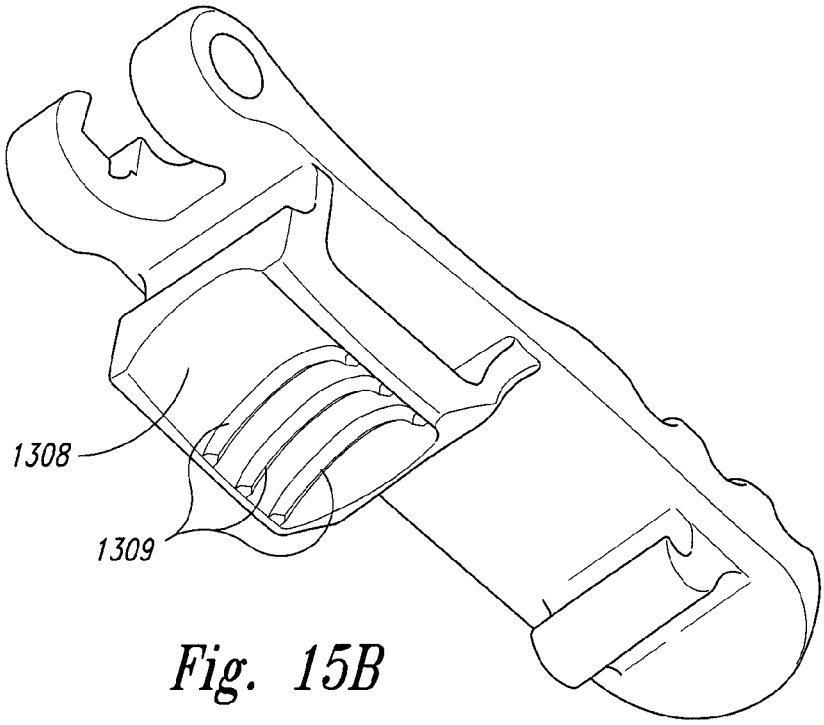

FIGS. 15A and 15B are enlarged top and bottom isometric views, respectively, of the latch 1221. As shown in FIG. 15A, the latch 1221 includes a first socket 1580*a* and an opposing second socket 1580*b* toward a front end portion of the latch 1221. The sockets 1580 pivotally receive the opposing pin portions 1474 of the attachment feature 1470 of the connector body 1202 (FIG. 14). Referring next to FIG. 15B, this view illustrates the concave, cylindrical clamping surface 1308 of the latch 1221. This view also illustrates the one or more ridges 1309 formed in the clamping surface 1308 to help retain the cable 1235 therebetween when the latches 1221 are in the "closed" position as shown in FIG. 13B.

Figure 16:
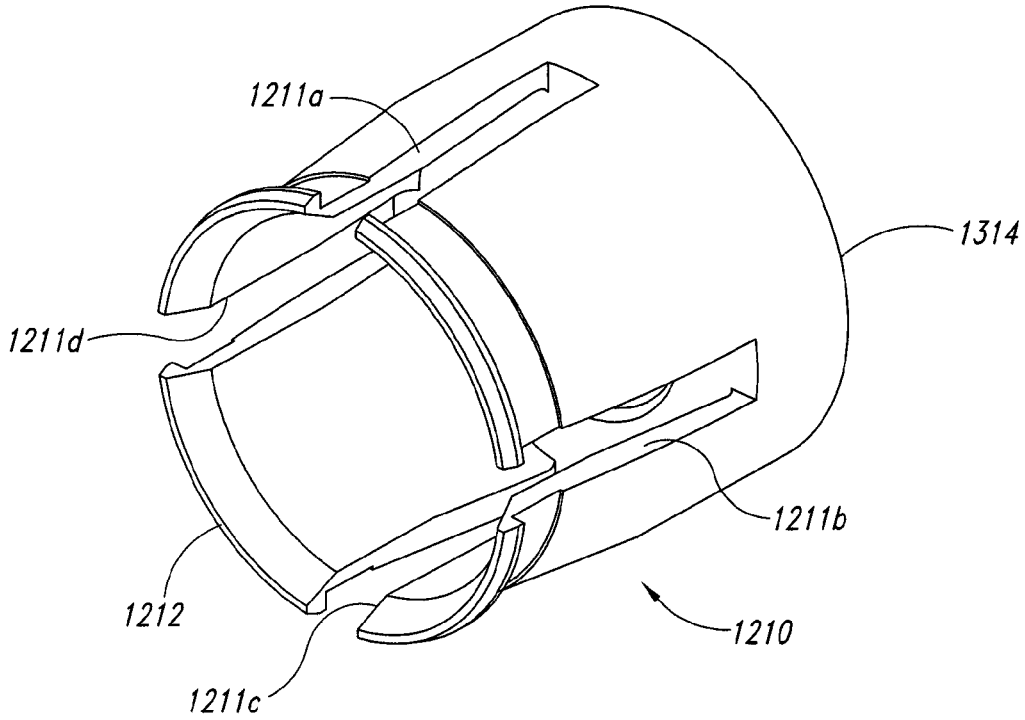
FIG. 16 is an enlarged isometric view of a collet configured in accordance with the present technology.

FIG. 16 is an enlarged front isometric view of the collet 1210. This view illustrates the slots 1211*a-d* which extend from the distal end 1212 toward the rear surface portion 1314. As discussed above, the slots 1211 enable the distal end 1212 to contract inwardly as the driving portions 1222 of the latches 1221 move the collet 1210 forward in the bore 1404 of the connector body 1202.

From the foregoing, it will be appreciated that specific embodiments have been described herein for purposes of illustration, but that modifications may be made without deviating from the spirit and scope of the various embodiments of the disclosure. The connector shown in the Figures, for example, can include more or less latches, threads, slots, etc. Additionally, as described above, the locking mechanism can be part of a male connector, but in other embodiments the locking mechanism can be on the female connector. Moreover, specific elements of any of the foregoing embodiments can be combined or substituted for elements in other embodiments. Certain aspects of the disclosure are accordingly not limited to automobile or aircraft systems. Furthermore, while advantages associated with certain embodiments of the disclosure have been described in the context of these embodiments, other embodiments may also exhibit such advantages, and not all embodiments need necessarily exhibit such advantages to fall within the scope of the technology. Accordingly, the disclosure is not limited except as by the appended claims.

I claim:

1. A first connector for operably coupling a cable to a mating second connector, the first connector comprising:

a connector body having an inner surface defining a first bore;

a collet movably received in the first bore, the collet having an inner surface defining a second bore configured to receive the second connector; and a locking mechanism operably coupled to the connector body and having an open position and a closed position, wherein the collet is configured to operably engage the second connector when the locking mechanism is in the closed position and release the second connector when the locking mechanism in the open position.

2. The first connector of claim 1 wherein a portion of the inner surface of the collet includes interior threads configured to engage exterior threads on the second connector.

3. The first connector of claim 1 wherein the first connector is a male F-type connector and the second connector is a female F-type connector.

4. The first connector of claim 1 wherein the inner surface of the collet is tapered inwardly toward a distal end portion.

5. The first connector of claim 1 wherein the inner surface of the connector body is tapered inwardly toward a distal end portion.

6. The first connector of claim 1 wherein the collet includes one or more slots positioned around a perimeter of a distal end portion of the collet, the slots being configured to contract when the locking mechanism moves to the closed position.

7. The first connector of claim 1 wherein:

the locking mechanism includes a latch having a clamping surface; and the connector body includes an opening configured to receive the clamping surface, the clamping surface being configured to engage a portion of a cable housed within the connector body when the locking mechanism is in the closed position.

8. The first connector of claim 1 wherein:

the inner surface of the connector body includes at least one raised feature protruding inwardly toward the collet; and the collet includes at least one slot configured to slidably receive the raised feature, the collet being configured to slide along the raised feature as the locking mechanism moves between the open and closed positions.

9. The first connector of claim 1 wherein:

the inner surface of the connector body includes at least one channel; and the collet includes at least one raised feature protruding outwardly from the collet, the raised feature being slidably received in the channel, and the collet being configured to slide along the channel as the locking mechanism moves between the open and closed positions.

10. The first connector of claim 1 wherein:

the first connector is a male F-type connector;

at least one of the inner surface of the connector body and the inner surface of the collet have a smaller diameter at the distal end portion than at the proximal end portion;

at least a portion of the inner surface of the collet includes internal threads; and the locking mechanism includes a first latch pivotally attached to the connector body and a second latch spaced circumferentially apart from the first latch and pivotally attached to the connector body, the first and second latches having a driving portion configured to slide the collet relative to the connector body toward a distal end portion as the locking mechanism moves from the open position toward the closed position.

11. The first connector of claim 1 wherein the inner surface of the collet is unthreaded.

12. The first connector of claim 1, wherein:

the connector body includes a sidewall with an opening in communication with the first bore;

the locking mechanism is positioned on the sidewall of the connector body and includes a driving portion, wherein the driving portion is configured to operably extend through the opening to press against an end portion of the collet to slide the collet forward relative to the connector body toward the second connector as the locking mechanism moves from the open position to the closed position; and the collet is configured to radially contract as the collet slides forward relative to the connector body.

13. The first connector of claim 1 wherein:

the first connector is a male coaxial cable connector; and the collet is sized to engage an outermost surface of a female coaxial cable connector as the locking mechanism moves from the open position to the closed position.

14. The first connector of claim 1 wherein the locking mechanism includes at least one latch pivotally attached to the connector body, and wherein the latch is configured to pivot radially inward toward the connector body as the locking mechanism moves to the closed position and drive the collet forward relative toward a distal end portion of the connector body.

15. A first connector for operably coupling a cable to a mating second connector, the first connector comprising:

a connector body having an inner surface defining a first bore;

a collet movably received in the first bore, the collet having an inner surface defining a second bore configured to receive the second connector; and a locking mechanism operably coupled to the connector body and having an open position and a closed position, wherein the collet is configured to operably engage the second connector when the locking mechanism is in the closed position and release the second connector when the locking mechanism is in the open position, and wherein the locking mechanism includes at least one latch pivotally coupled to the connector body.

16. The first connector of claim 15 wherein the latch includes a driving portion configured to bear against a proximal end portion of the collet and move the collet relative to the connector body as the latch moves to the closed position.

17. The first connector of claim 15 wherein the latch includes a locking portion having an engagement feature configured to engage a corresponding portion of the connector body when the latch is in the closed position.

18. The first connector of claim 17 wherein the engagement feature includes a hook configured to engage an edge of a proximal end portion of the connector body when the latch is in the closed position.

19. A connector, comprising:

a collet having an inner surface defining a bore, the bore being configured to receive a mating connector;

a locking mechanism operably coupled to the collet, the locking mechanism having an open position and a closed position, wherein the locking mechanism is configured to drive the collet into compressible engagement with the mating connector as the locking mechanism moves from an open position toward the closed position, and wherein the locking mechanism is configured to release the collet from the mating connector as the locking mechanism moves away from the closed position toward the open position; and a connector body having a tapered bore that slidably receives the collet.

20. The connector of claim 19 wherein the locking mechanism includes at least one latch having a driving portion that moves the collet relative to the connector body as the latch moves to the closed position.

21. The connector of claim 19 wherein the collet includes a plurality of slots positioned circumferentially around an end portion of the collet, the slots being configured to contract as the locking mechanism moves to the closed position.

22. The connector of claim 19 wherein:

the connector body has an inner surface defining the tapered bore; and the connector further comprises a plurality of guide features on the inner surface of the connector body, the guide features being configured to limit rotation of the collet with respect to the connector body.

23. The connector of claim 19 wherein the collet is configured to engage a smooth surface of the mating connector.

24. The connector of claim 19 wherein locking mechanism includes a driving portion configured to bear against an end portion of the collet to drive the collet forward relative to the connector body toward the mating connector, wherein the tapered bore compresses the collet radially inward as the collet slides toward the mating connector.

25. A method of operably coupling a first connector on a cable to a second connector, the method comprising:

positioning the first connector proximate to the second connector, the first connector including a connector body having a first bore, a collet slidably received in the first bore and configured to receive the second connector in a second bore, and a locking mechanism configured to cooperate with the collet to slide the collet back and forth with respect to the connector body; and moving the locking mechanism from an open position toward a closed position to drive the collet longitudinally forward in the first bore of the connector body toward the second connector and radially contract the collet onto the second connector.

26. The method of claim 25, further comprising engaging a locking portion of the locking mechanism with an engagement feature on the connector body to hold the locking mechanism in the closed position.

27. The method of claim 25 wherein moving the locking mechanism includes pivoting at least one latch inwardly toward the first connector from the open position toward the closed position.

28. The method of claim 27, further comprising engaging the cable between at least two opposing clamping portions of the locking mechanism when the latch is in the closed position.

29. The method of claim 25 wherein the collet includes an end portion proximate to the second connector, and wherein the method further comprises contracting the end portion of the collet from a first diameter to a second diameter as the locking mechanism moves from the open position toward the closed position, the second diameter being smaller than the first diameter.

30. The method of claim 25, further comprising engaging an unthreaded exterior surface of the second connector with the contracted collet.

* * * * *